United States Patent [19]

Gallagher

[11] 4,114,185

[45] Sep. 12, 1978

[54] ELECTRIC FENCE CONTROLLERS

[75] Inventor: William Murray Gallagher, Hamilton, New Zealand

[73] Assignee: Gallagher Electronics Limited, Hamilton, New Zealand

[21] Appl. No.: 757,288

[22] Filed: Jan. 6, 1977

Related U.S. Application Data

[63] Continuation of Ser. No. 568,101, Apr. 14, 1975, abandoned.

[51] Int. Cl.[2] ..... H05C 1/04

[52] U.S. Cl. ..... 361/232; 323/19; 323/81; 340/56

[58] Field of Search ..... 256/10; 307/106, 132 R; 315/209 CD, 209 SC; 323/8, 19, 22 SC, 81; 340/254; 361/232; 363/23, 59, 61

[56] References Cited

U.S. PATENT DOCUMENTS

| | | | |
|---|---|---|---|
| 2,981,854 | 4/1961 | Grace et al. | 256/10 X |
| 3,422,280 | 1/1969 | Olson | 307/132 R |
| 3,450,982 | 6/1969 | Dvorak | 323/81 |
| 3,478,259 | 11/1969 | Bradley | 323/81 X |
| 3,581,299 | 5/1971 | Schmit | 256/10 |
| 3,900,786 | 8/1975 | Jordan | 363/23 |

OTHER PUBLICATIONS

N.Z.S.S. 1525:1962, New Zealand Standard Specification for Mains Operated Electric Fence Controllers, New Zealand Standards Institute, Nov. 1962, pp. 3–20.

*Primary Examiner*—A. D. Pellinen

*Attorney, Agent, or Firm*—Wenderoth, Lind & Ponack

[57] ABSTRACT

An electric fence controller having a capacitor which can be charged to a predetermined voltage. A timer which discharges the capacitor at fixed intervals of time and a transformer, the primary of which is connected across the capacitor and the secondary of which is connected to a load and to an impedance connected to the primary or secondary of the transformer. The impedance when measured at the operating voltage from the secondary terminals of the transformer is less than the normal fence line impedance.

2 Claims, 3 Drawing Figures

ELECTRIC FENCE CONTROLLERS

This application is a continuation application of Ser. No. 568,101, filed Apr. 14, 1975, now abandoned.

BACKGROUND OF THE INVENTION

This invention relates to electric fence controllers.

There are conflicting requirements for electric fences in that the fence must be safe to humans and animals and yet have a low impedance output to make the fence capable of electrifying many miles of electric fence where vegetation may be in contact with the wire and with the considerable electrical capacity of a large length of fence wire. The requirements of safety can be met by producing a controller that complies with the requirements of NZSS 1525 1962 and SAA C129 (1959) and other international standards from which these are derived.

SUMMARY OF THE INVENTION

It is therefore an object of the invention to provide an electric fence controller which we believe will go at least a considerable distance towards meeting these conflicting requirements or which will at least provide the public with a useful choice.

Accordingly the invention consists of an electric fence controller comprising a capacitance adapted to be charged from a suitable voltage source to a substantially predetermined voltage, timing means adapted to discharge said capacitance at fixed intervals of time, and a transformer, the primary of which is connected across said capacitance, and the secondary of which is connected to the load and to an impedance, which impedance when measured at the operating voltage from the secondary terminals of the transformer is less than the normal fence line impedance.

To those skilled in the art to which this invention relates, many changes in construction and widely differing embodiments and applications of the invention will suggest themselves without departing from the scope of the invention as defined in the appended claims. The disclosures and the description herein are purely illustrative and are not intended to be in any sense limiting.

BRIEF DESCRIPTION OF THE DRAWINGS

One preferred form of the invention will now be described with reference to the accompanying circuit diagrams in which.

DETAILED DESCRIPTION OF THE INVENTION

Figure 1:
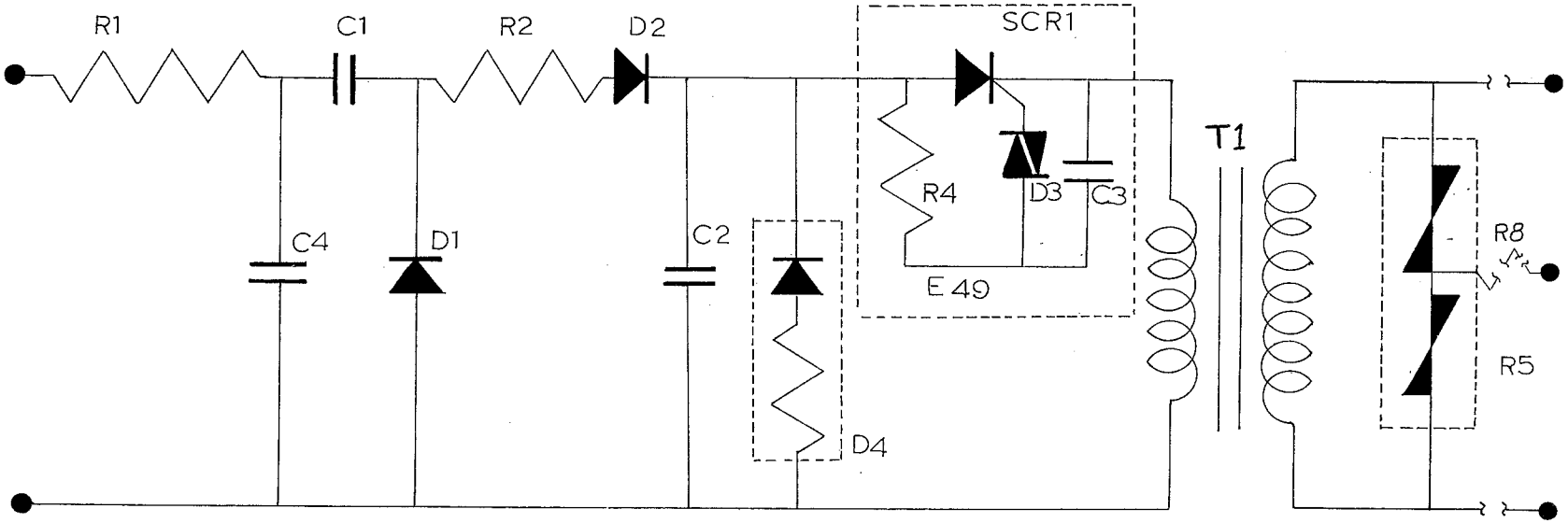
FIG. 1 is a circuit diagram of an electric fence controller according to the invention.

Referring to FIG. 1, a main bank of capacitors C2 of, for example, about 30 microfarad capacity is charged from rectified mains voltage through a voltage doubler circuit consisting of capacitor C1, a pair of diodes D1 and D2 and limit resistors R1 and R2. The condenser bank C2 comprises a main bank of capacitance and consists of one or more power factor correction type oil filled paper capacitors of over 5 microfarads each. The benefit of this type and size of capacitors are:

(a) Low internal losses, then no heating occurs with the rapid discharge, (b) A highly reliable component, as it is sealed and does not deteriorate with age, (c) The large capacitor is used to allow great wastage due to the load resistance to be described further shortly.

Figure 2:
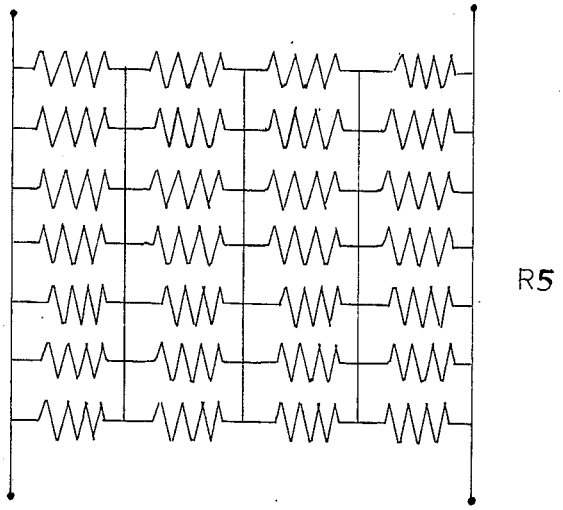
FIG. 2 is a circuit diagram of a preferred form of output resistor.

The condenser bank C2 is discharged at suitable intervals of time by means of a timing circuit consisting of a high value series resistor R4 charging a capacitor C3 which overeaching a predetermined voltage fires a diac D3 which switches a silicon controlled rectifier SCR1 to discharge the said capacitor through the transformer, the secondary of the transformer T being connected at the upper terminal to the fence line and at the lower terminal to a ground and also at the center to an impedance R5 having a load less than the normal fence load which impedance for prior fence controllers was required to be greater than 10,000 ohms. Also, a resistor $R_8$ may be provided to produce a reduced voltage; i.e., a voltage divider. This impedance R5 may comprise a voltage dependant resistor R5 or a resistor such as a 180 ohm resistor or alternatively some or all of the load or voltage dependant load can be applied across the primary. The load is preferably of a lesser impedance than 1,000 ohms, and is preferably about 400 ohms. The load actually used in the preferred form is 380 ohms as mentioned above. The preferred load as shown in FIG. 2 is constructed of 28 individual 680 ohms resistors in seven parallel groups of four resistances in series with equipotential junctions connected together. The resistor R5 is connected into the circuit by connecting one common rail thereof to the line leading to the fence line connection and by connecting the other common rail thereof to the ground connection. The center tap can be taken from any of the other common potential lines thereof. Thus, the failure of any two resistors alters the output less than 7.5%.

Figure 3:
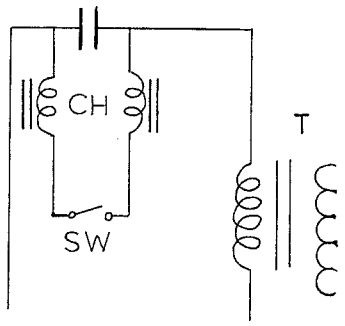
FIG. 3 is a circuit diagram of an alternative switch for use in an electric fence controller according to the invention.

As shown in FIGS. 3 the condenser bank C2 is discharged by closing switch SW which is in series with the choke coils CH, and discharged through the primary of the transformer T.

The switch SW can be opened and closed cyclically and mechanically, a synchronous motor rotating the switch and operating it at the desired frequency. Alternatively, the silicon controlled rectifier SCR 1 is used for switching.

The secondary loading is such that any two components of it may be disconnected and the output not increase more than 20%.

The object here is to allow any two components to fail by open-circuiting or short-circuiting and have the output of the controller be safe, i.e., it does not exceed the maximum voltage output or other criteria output as specified in the safety standards.

About 50% of the energy obtainable from the condenser C2 is discharged through the resistance R5, thus about 50% of the energy is, in effect, wasted. However, the heavy wound low turns ratio maximum energy transfer transformer is thus prevented from exceeding the statutory 5,000 volts discharge under good conditions, but will still discharge a satisfactory voltage under poor fence conditions, i.e. during wet weather or when vegetation is touching parts of the fence line.

Accordingly this invention allows the fence controller to electrify a much greater length of wire before the shock is reduced to a level where it is not effective as a stock deterrent.

The usual electric fence controller has no secondary loading, or if so, only of insignificant amount to work indicator lights or reduce high voltage peaks and accordingly no close control of output voltage is possible. The present construction provides control of voltage in a very satisfactory manner that is acceptable to the Standards Association.

To Summarize: The novel features of the preferred form of invention are:

(a) Load or wastage of energy on the output or primary in such a manner that the load exceeds the normal fence line load, nominally 1,000 ohms (when measured at 5,000 volts).

(b) The output is loaded in such a manner that any two components of the artificial load can be shorted or disconnected without any great change in the output or specifically with a change of less than 20%.

(c) The use of highly reliable high discharge rate type of over 10 microfarad in electric fence controllers.

What we claim is:

1. A device connected to a voltage source and an electric fence having a normal fence line impedance for controlling said electric fence, said device comprising:

a capacitance connected to and adapted to be charged by said voltage source to a substantially predetermined voltage;

timing means operatively connected to said capacitance for discharging said capacitance at fixed time intervals;

a transformer, the primary thereof connected across said capacitance and said timing means and the secondary thereof connected to the fence and to a ground; and an impedance connected to said transformer, said impedance measured at the operating voltage for the secondary terminals of said transformer being less than the fence line impedance, and said impedance being comprised of a plurality of resistors connected in series parallel arrangement in such a manner that failure of less than three resistors will not materially alter the overall resistance of said resistors 2. A device connected to a voltage source and an electric fence having a normal fence line impedance for controlling said electric fence, said device comprising:

a capacitance connected to and adapted to be charged by said voltage source to a substantially predetermined voltage;

timing means operatively connected to said capacitance for discharging said capacitance at fixed time intervals;

a transformer, the primary thereof connected across said capacitance and said timing means and the secondary thereof connected to the fence and to a ground; and an impedance connected to said transformer, said impedance measured at the operating voltage for the secondary terminals of said transformer being less than the fence line impedance, and said impedance being comprised of seven parallel groups of four resistances in series having equipotential junctions between said resistors connected together.

* * * * *